United States Patent [19]

Kuo

[11] 3,950,064

[45] Apr. 13, 1976

[54] MODULAR CONNECTOR

[75] Inventor: Ted L. C. Kuo, Fanwood, N.J.

[73] Assignee: Thomas & Betts Corporation, Elizabeth, N.J.

[22] Filed: Dec. 30, 1974

[21] Appl. No.: 537,583

[52] U.S. Cl. ..... 339/97 C; 339/276 T
[51] Int. Cl.[2] ..... H01R 11/20; H01R 5/08
[58] Field of Search ..... 339/95 R, 96, 97 C, 97 P, 339/97 R, 98, 276 R, 276 T

[56] References Cited

UNITED STATES PATENTS

| | | | |
|---|---|---|---|
| 3,480,723 | 11/1969 | Golden | 339/97 C X |
| 3,715,705 | 2/1973 | Kuo | 339/98 |
| 3,842,191 | 10/1974 | Neale | 339/97 C X |

*Primary Examiner*—Roy Lake
*Assistant Examiner*—Howard N. Goldberg
*Attorney, Agent, or Firm*—David Teschner; Jesse Woldman

[57] ABSTRACT

A modular connector assembly comprises discrete connector members each having upstanding leg portions disposed in a specific alternating arrangement along opposite sides of a base portion so as to interlock with the leg portions of an adjacent connector member to provide a composite structure having discrete wire receiving cavities. Mating projections and recesses may be provided along opposing sides of the leg portions to serve as additional locking means between the connector members. In a further embodiment, a slotted divider may be interposed between oppositely positioned connector members to provide the discrete wire receiving cavities.

18 Claims, 11 Drawing Figures

MODULAR CONNECTOR

BACKGROUND OF THE INVENTION

1. Field of the Invention

The invention is directed to the field of connecting devices and principally to a crimpable multicompartment connector.

2. Description of the Prior Art

Many electrical applications require the termination of combinations of differently sized and configured conductors at a single terminating point. For this purpose, there have been developed various multicompartment connectors having individual wire receiving channels or cavities adapted to selectively accept a given range and configuration of conductors therewithin. A typical device for use in such applications is exemplified in U.S. Pat. No. 3,715,705 issued to L. C. Kuo on Feb. 6, 1973, and assigned to the assignee of the instant invention. The individual compartments of such devices, however, are fixed in number and size, due to the integral construction thereof, and are therefore of limited use in applications where either more or less compartments of either similar or different size are required. Furthermore, the user is required to stock a rather large range of such prior art devices to accommodate the numerous combinations of conductor sizes and configurations found in many typical applications.

SUMMARY OF THE INVENTION

The invention overcomes the limitations and difficulties noted above with respect to prior art devices by providing a modular connector construction which is more versatile, convenient, and reliable than such prior art devices. The modular connector features the employment of discrete, individual connector members arranged to interlock with one another to provide a composite structure in which the user controls the number and size of conductor receiving compartments available in the final connector. Each connector member comprises a generally U-shaped member having a base portion and upstanding leg portions, the latter being disposed in an alternating arrangement along opposite sides of the base portion and proportioned to interlock with the leg portions of an adjacently disposed connector member. The connector members may be joined to one another by orienting the leg portions of a pair of connector members in either similar or opposing orientation, the latter arrangement permitting the further inclusion of a slotted divider means between the connector members to provide discrete wire receiving cavities, each sharing a common base. The divider means may be provided with a plurality of paired slots to form a base for a series of connector member pairs thereby providing a multiple terminal point for a corresponding series of modular connectors. The connector members may further comprise a tongue portion for attaching the modular connector to a support member, terminal block, or further connector member. It is therefore an object of this invention to provide an improved connector.

It is a further object of this invention to provide a modular connector.

It is another object of this invention to provide means for preselectively structuring a modular connector.

It is yet another object of this invention to provide means for assembling discrete connector elements into a composite connector assembly.

It is still another object of this invention to provide a modular connector comprising interlocking modules.

It is yet a further object of this invention to provide a means for selectively expanding the wire receiving capacity of a terminating connector.

It is yet another object of this invention to provide a modular connector having universal modules arranged to be interlockingly engaged with one another to form a composite structure.

Other objects and features will be pointed out in the following description and claims and illustrated in the accompanying drawings which disclose, by way of example, the principle of the invention and the best modes contemplated for carrying it out.

BRIEF DESCRIPTION OF THE DRAWINGS

In the Drawings.

Similar elements are given similar reference characters in each of the respective drawings.

DESCRIPTION OF THE PREFERRED EMBODIMENTS

Figure 1:
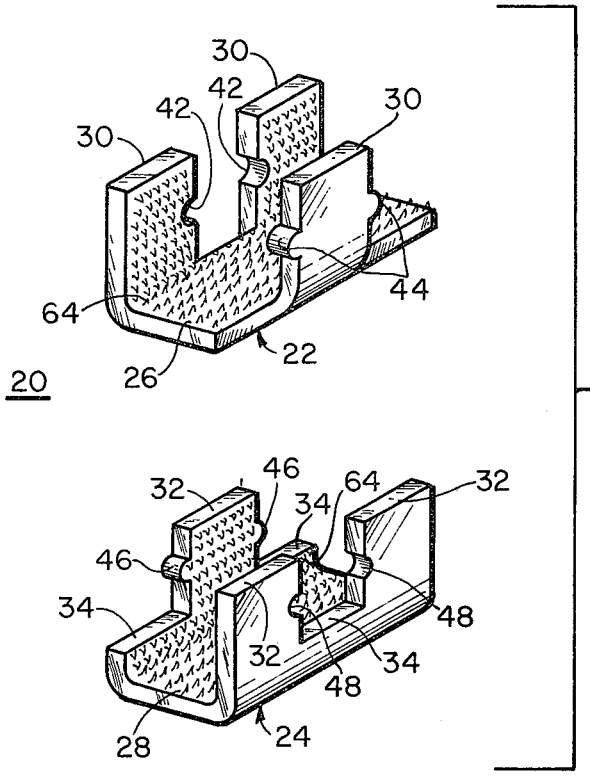
FIG. 1 is a perspective view of a disassembled modular connector constructed in accordance with the concepts of the invention.
Figure 2:
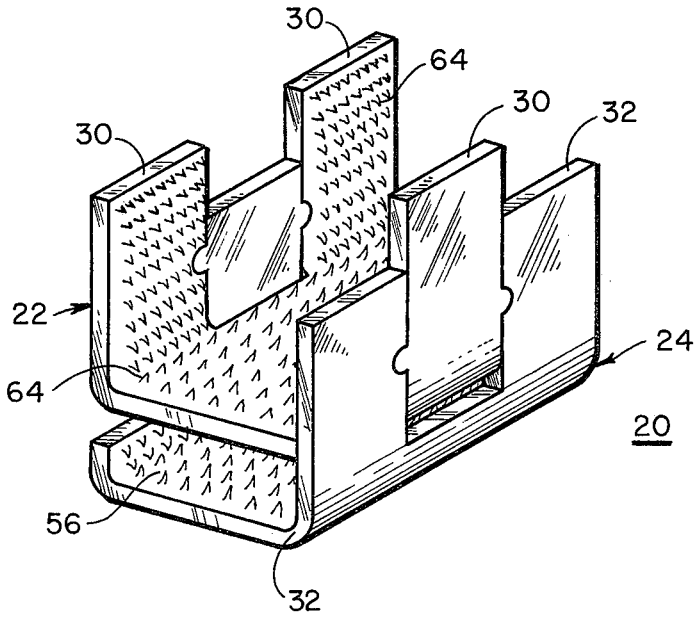
FIG. 2 is a perspective view of the device of FIG. 1 in an assembled state.
Figure 3:
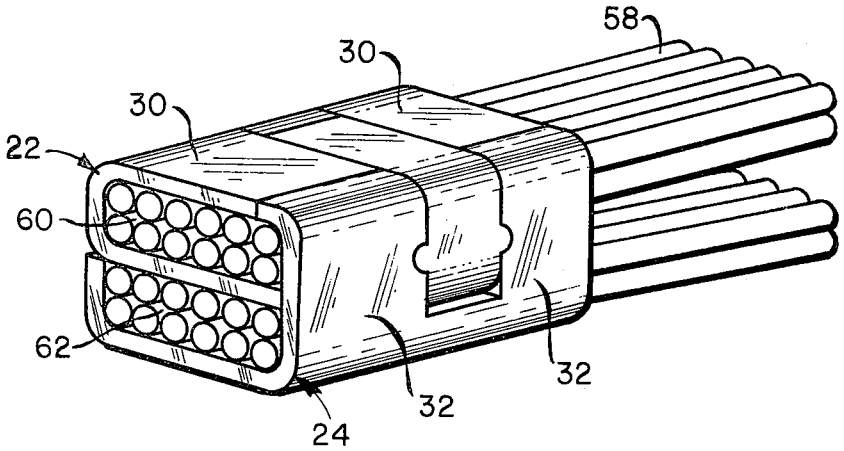
FIG. 3 is a perspective view of the device of FIG. 1 crimped about a plurality of wires.
Figure 10:
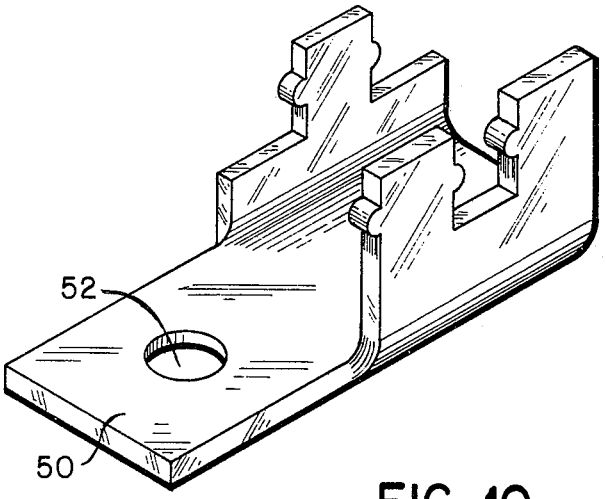
FIG. 10 is a perspective view of a further embodiment of a connector member constructed in accordance with the concepts of the invention.
Figure 11:
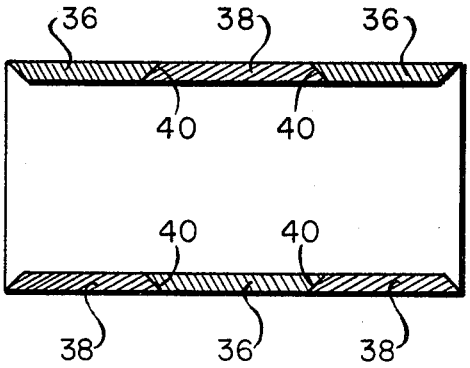
FIG. 11 is a top plan view, partly in section, of a further embodiment of a modular connector constructed in accordance with the concepts of the invention.

Turning now to FIGS. 1, 2, and 3 there is shown a modular metallic connector 20 constructed in accordance with the concepts of the invention and comprising a first connector member 22 and a second connector member 24 arranged to interlock with one another as will be described in greater detail hereafter. The first and second connector members 22 and 24, respectively, each comprise a respective base portion 26, 28, and respective upstanding leg portions 30, 32. Each of the connector members 22 and 24 may be conveniently blanked preferably from electrically conductive flat stock material such as copper, brass, aluminum, or the like, and formed into the desired shape either as individual pieces or in continuous strip (not shown) which may be scored or otherwise weakened at selective intervals for convenient separation by the user. As illustrated, the leg portions 30 and 32 are located along opposing sides of the respective connector member base portions 26 and 28 in an alternating arrangement, that is, the single leg portion 30, 32 disposed along one side of its respective base portion 26, 28, is bisected by a lateral axis located intermediate the two corresponding leg portions 30, 32 disposed along the opposing side of its respective base portion 26, 28 so that each group of three leg portions 30, 32 describes a triangular pattern, in plan view. The width of the leg portions 30, 32 and the spacing between adjacent leg portions 30, 32 is arranged in such manner as to provide interlocking engagement between the leg portion 30 of the first connector member 22 and the leg portions 32 of the second connector member 24, essentially as shown in FIG. 2. In the particular embodiment illustrated in FIGS. 1 and 2, the leg portions 30 and 32 are all of equal width, and the spacing between adjacently disposed leg portions associated with one of the connector members 22 and 24 is proportioned to be equal to the width of a mating leg portion associated with the other connector member. Accordingly, the pattern described by the leg portions 30 of connector member 22 may be arranged essentially identical to the pattern described by the leg portions 32 of connector member 24 in both form and dimension, for manufacturing convenience and universality of assembly. The second connector member 24 may further comprise upstanding shoulder portions 34 extending upwardly a short distance from the base portion 28 and generally normal to the plane thereof to provide a support for the base portion 26 of the first connector member 22 as the two connector members are assembled together in the manner illustrated in FIG. 2. Although each of the leg portions may be configured to have an essentially rectangular shape, in transverse section, the sides thereof may be selectively tapered to define generally an isosceles trapezoid, in transverse section, as shown in the embodiment illustrated in FIG. 11. In that embodiment, there is provided a first series of leg portions 36 associated with a first connector member and interlocked with a second series of leg portions 38 associated with a second connector member and alternatingly arranged in the manner shown in FIGS. 1 and 2, but differing therefrom, however, in that the sides of the leg portions 36 and 38 are selectively tapered for mating interengagement, as at 40, to provide an additional locking effect therebetween. It will, of course, be readily apparent to those skilled in the art that other slidably mating interlocking arrangements such as ribs and recesses, and various tongue and groove configurations (not shown) may be provided in a similar manner without departing from the spirit of the invention and within the concepts herein disclosed. Returning to the embodiment illustrated in FIGS. 1 and 2, the first connector member leg portions 30 are alternately provided with transverse recesses 42 and transverse protrusions 44 adapted to mate with complementary transverse protrusions 46 and transverse recesses 48 provided along the sides of the second connector member leg portions 32. Consequently, the first and second connector members 22 and 24 may be assembled to one another with their respective leg portions 30 and 32 extending in a common direction, as shown in FIG. 3, with the recesses and protrusions 42 and 44, respectively, of the first connector member 22 interlocked with the mating protrusions and recesses 46 and 48, respectively, of the second connector member 24 to provide added assurance, where necessary or desirable, that the composite assembly will remain essentially intact during handling and storage where, due to manufacturing tolerances, the frictional engagement between the interfitting leg portions may be insufficient to overcome abusive handling of the composite assembly before termination. As further illustrated in FIG. 10, the second connector member 28 may be provided with an extending tongue portion 50 which may be suitably apertured, as at 52, to facilitate attachment of the assembled modular connector to a further device or terminal support (not shown). After the first and second connector members 22 and 24, respectively, have been assembled to provide the modular connector arrangement shown in FIG. 3, there is then provided a pair of discrete, overlapping wire receiving channels 54 and 56 (FIG. 3) defined by the respective base and leg portions of the connector members 22 and 24. The height of the lower channel 56 may be controlled by varying either the height of the shoulder portions 34 of the second connector member 24 or by selectively positioning the mating recesses and protrusions 42, 48, 44, and 46 located along the sides of the leg portions 30 and 32. In the former case, a variable lower channel height may be obtained, whereas in the latter case, a fixed predetermined height is provided. The modular connector 20 may now be crimped about a plurality of, for example, stranded wires such as 58 which may be divided into two groups comprising a first group 60 and a second group 62, with each group occupying a particular channel 54, 56. Since the multiple channel arrangement provides a greatly increased surface area of contact with the conductors, when compared with a single channel of essentially equivalent cross section, each of the individual stranded wires 58 is exposed to a greater surface area of the connector 20 than would be the case with a single channel. As further shown in FIG. 3, the leg portions 30 and 32 of the respective connector members 22 and 24 are crimped inwardly towards one another to provide discrete bands about the enclosed conductors while further interlocking the first and second connector members together. The inner surfaces of either or both of the connector members 22 and 24 may be further provided with piercing teeth 64 (FIGS. 1 and 2) which may be advantageously employed to penetrate the surface of the wires 58 and engage the interior thereof for additional contact, or to pierce through any electrically insulative film or covering which may exist, to insure the electrical integrity of the completed connection. Where a greater wire receiving capacity is required, further connector members such as 22 and 24 may be interlocked to one another in overlying relationship in a similar manner. Accordingly, the connector assembly may comprise three or more of such modules with a corresponding increase in the number of wire receiving cavities or channels available for use.

Figure 4:
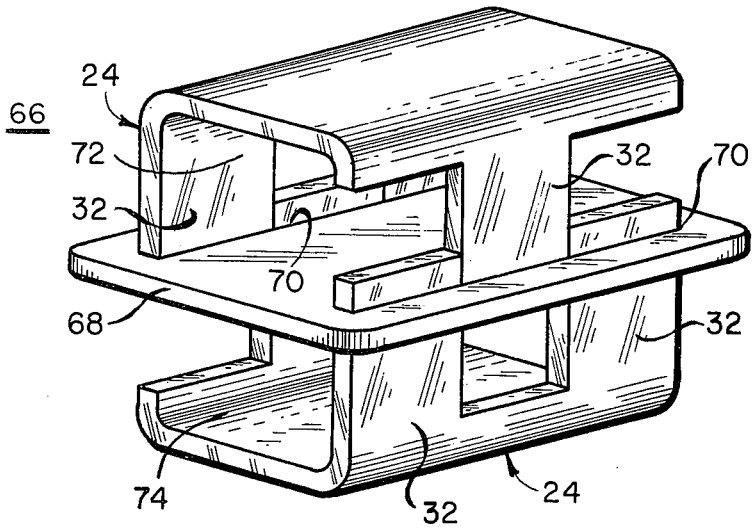
FIG. 4 is a perspective view of a further embodiment of a modular connector constructed in accordance with the concepts of the invention.
Figure 5:
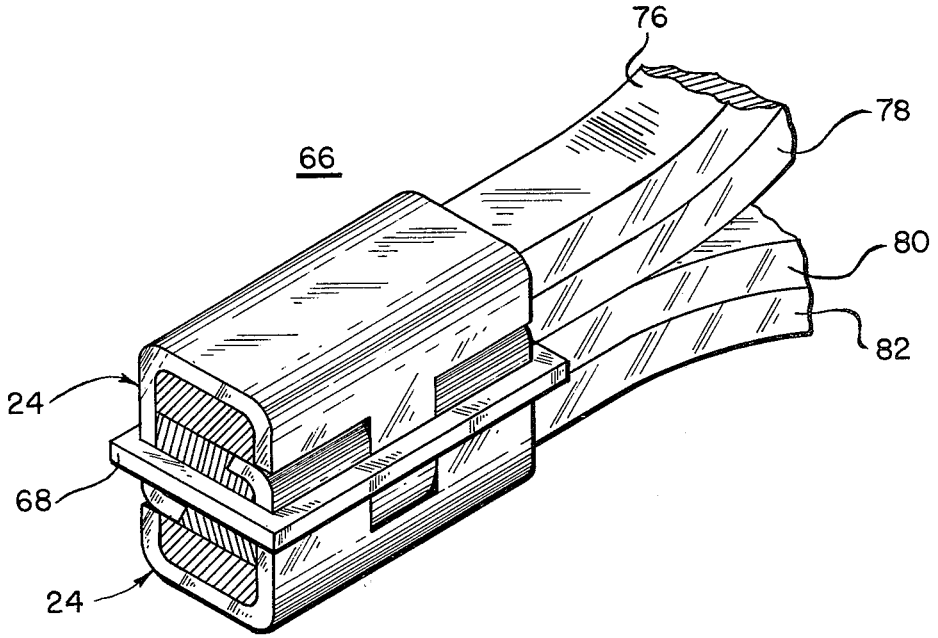
FIG. 5 is a perspective view of the device of FIG. 4 crimped about a plurality of wires.

Referring now to FIGS. 4 and 5, there is shown a further embodiment of a modular connector 66 constructed in accordance with the concepts of the invention. For the sake of convenience, the connector 66 is shown as comprising two identical second connector members 24 disposed in face to face interlocking relationship with a divider means such as a plate 68 interposed therebetween. The plate 68 is provided with a pair of parallel slots 70 adapted to intimately receive the corresponding intermeshing leg portions 32 of the connector members 24. The assembled connector 66 thus also comprises two discrete wire receiving cavities or channels 72 and 74 except that, in this case, each of the cavities 72 and 74 shares a common central support provided by the plate 68. It will be readily apparent that although the connector 66 is shown as constructed from a pair of connector members 24, a pair of connector members 22 may be similarly employed to provide a modular arrangement similar to that illustrated in FIG. 4, or, in the alternative, the two connector members 22 and 24 may be combined to achieve a corresponding assembly. In FIG. 5 there is shown a completed connection in which a plurality, namely four, solid conductors 76, 78, 80, and 82, have been separated into two groups each comprising two of the conductors with each group being secured within a respective one of the two wire receiving channels 72 and 74 by crimping the entire combination together in a suitable press or crimping tool (not shown). As is clearly shown in FIG. 5, at least one surface of each of the conductors is in direct contact with an adjacent interior surface of the modular connector 66 thereby insuring a high degree of electrical integrity of the completed connection. Although not shown in the embodiment illustrated in FIGS. 4 and 5, each of the connector members may be provided with piercing teeth such as 64, where necessary or desirable.

Figure 6:
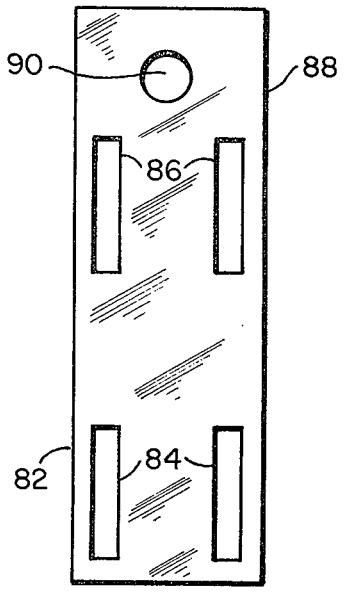
FIG. 6 is a top plan view of a divider means of a modular connector constructed in accordance with the concepts of the invention.
Figure 7:
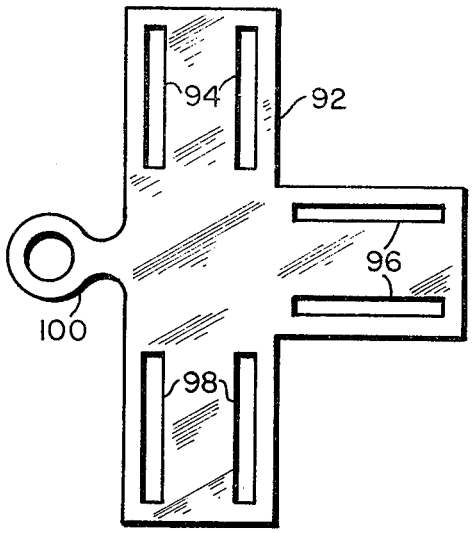
FIG. 7 is a top plan view of a further embodiment of a divider means constructed in accordance with the concepts of the invention.
Figure 8:
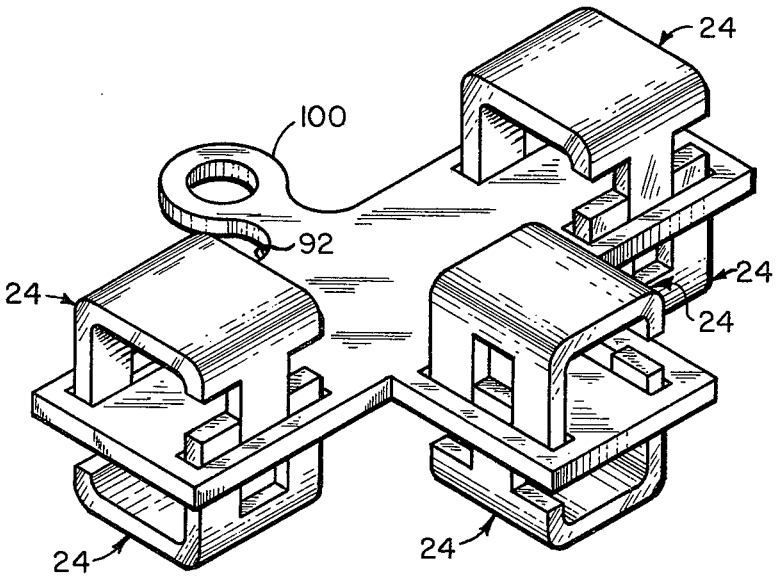
FIG. 8 is a perspective view of an modular connector assembly employing the divider means shown in FIG. 8.

Turning now to FIGS. 6, 7, and 8, the divider means may comprise an extended plate 82 having more than one, namely two, pair of selectively spaced slots 84, 86, each pair corresponding to the slots 70 in plate 68 to increase the wire receiving capacity of the total combination. The plate 82 may further comprise a tongue portion 88, apertured as at 90 for attaching the assembly to a further member (not shown). The embodiment illustrated in FIGS. 7 and 8 is a further expansion of the embodiment shown in FIG. 6 and comprises a T-shaped plate 92, each arm of which is provided with a pair of spaced slots 94, 96, and 98, respectively, arranged to accommodate a respective pair of connector members 24 essentially as described above with respect to the embodiment shown in FIG. 4. The plate 92 may also further include an integral tongue portion 100 which may be employed in a manner similar to that described above with respect to the tongue portions 50 and 88. This same concept may, of course, be expanded to include divider means formed in a wide variety of shapes and including paired slots selectively located about the surface thereof to further increase the capacity of the modular connector.

Figure 9:
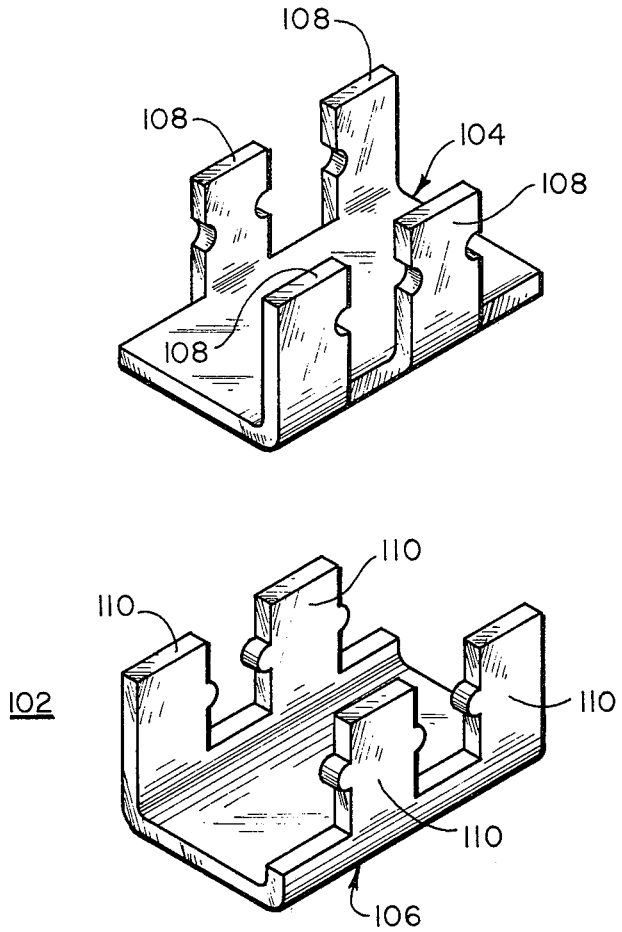
FIG. 9 is a perspective view of a further embodiment of the connector members of a modular connector constructed in accordance with the concepts of the invention.

Referring now to FIG. 9, there is shown a further embodiment of a disassembled modular connector 102 constructed in accordance with the concepts of the invention and comprising a first connector member 104 and a second connector member 106, each essentially similar to the connector members 22 and 24 but each including, respectively, a greater number of, namely four, selectively proportioned leg portions 108, 110 arranged in an alternating configuration so that the leg portions 108 of the first connector member 104 may be intermeshed with the leg portions 110 of the second connector member 106 to provide an interlocked composite modular assembly essentially as described above with respect to the embodiment illustrated in FIGS. 1 and 2. It will be readily apparent that the alternating staggered arrangement of leg portions need not be limited to any fixed number, but may be expanded, where necessary or desirable, to provide an increased number of conductor engaging bands formed by crimping or folding the respective leg portions about the conductors inserted within the respective wire receiving channels or cavities defined by the inner surfaces of the assembled connector members. It should also be noted that each of the leg portions 30, 32, 108, and 110 are preferably proportioned to have a foldable length at least equal to the width of its corresponding base portion so as to insure adequate encirclement of the contained conductors. Furthermore, the embodiment illustrated in FIG. 9 may also include a divider means such as plates 68, 82, and 92 whereby the connector members 104 and 106 will be assembled to one another in face to face disposition with the divider means interposed therebetween in a manner similar to that shown in FIG. 4.

The embodiments of the invention in which an exclusive property or privilege is claimed are defined as follows:

1. A modular connector comprising: a first connector member having a base portion and foldable leg portions extending upwardly from said base portion in a first alternating arrangement along opposite sides of said base portion; and a second connector member have a base portion and foldable leg portions extending upwardly from said second connector member base portion in a second alternating arrangement along opposite sides of said second connector member base portion, said second alternating arrangement being complementary to said first alternating arrangement so that said first and said second connector members may be disposed adjacent one another with said first and said second connector member leg portions extending in a common direction and said leg portions of said first connector member interlocked with said leg portions of said second connector member.

2. A modular connector as defined in claim 1 wherein one of said first and said second connector members further comprises upstanding shoulder portions located adjacent its respective leg portions for supporting the other of said first and said second connector members in spaced relationship with respect thereto.

3. A modular connector as defined in claim 1 wherein at least one of said first and said second connector members further comprises a tongue portion extending outwardly from its respective base portion for attachment to a further member.

4. A modular connector as defined in claim 1 wherein said first connector member leg portions are of substantially equal length.

5. A modular connector as defined in claim 1 wherein the length of each of said first connector member leg portions is at least equal to the width of said first connector member base portion.

6. A modular connector as defined in claim 1 wherein the inner surface of each of said first and said second connector members further comprises piercing means extending outwardly therefrom for engagement with a conductor about which a respective one of said first and said second connector members is compressed.

7. A modular connector as defined in claim 1 wherein each of said first and second connector members is formed from highly conductive metallic material.

8. A modular connector as defined in claim 1 wherein each of said first and second connector member base portions has a generally rectangular configuration, the length and width of said first connector base portion being generally equivalent to the length and width of said second connector member base portion.

9. A modular connector as defined in claim 1 wherein said first and said second connector members comprise an equal number of said leg portions.

10. A modular connector as defined in claim 9 wherein each of said first and said second connector members comprises an odd number of said leg portions.

11. A modular connector as defined in claim 9 wherein each of said first and said second connector members comprises an even number of said leg portions.

12. A modular connector as defined in claim 9 wherein said first and said second connector member leg portions are all of equal width.

13. A modular connector as defined in claim 9 wherein each of said first and said second connector members comprises three leg portions, two of said leg portions of a respective one of said first and said second connector members being located along one side of said base portion and the remaining leg portion being located along the opposing side of said base portion.

14. A modular connector as defined in claim 9 wherein each of said first and said second connector members comprises four leg portions arranged so that two of said leg portions are located along each of the opposing sides of a respective one of said first and second connector member base portions.

15. A modular connector comprising: a first connector member having a base portion and foldable leg portions extending upwardly from said base portion in a first alternating arrangement along opposite sides of said base portion; a second connector member have a base portion and foldable leg portions extending upwardly from said second connector member base portion in a second alternating arrangement along opposite sides of said second connector member base portion, said second alternating arrangement being complementary to said first alternating arrangement so that said first and said second connector members may be disposed adjacent one another with said first and said second connector member leg portions extending towards one another and said leg portions of said first connector member interlocked with said leg portions of said second connector member; and divider means positionable intermediate said first and said second connector means to provide discrete connector compartments.

16. A modular connector as defined in claim 15 wherein said divider means comprises a planar member having opposed parallel transverse slots selectively spaced apart to receive said first and said second connector member leg portions therethrough.

17. A modular connector as defined in claim 16 wherein said planar member further comprises a tongue portion integral therewith for attachment to a further member.

18. A modular connector as defined in claim 16 wherein said planar member has at least one pair of said transverse slots for receiving the respective leg portions of one said first connector member and one said second connector member.

* * * * *